US010494852B2

(12) United States Patent
Fujita et al.

(10) Patent No.: US 10,494,852 B2
(45) Date of Patent: Dec. 3, 2019

(54) DOOR OPENING/CLOSING DEVICE

(71) Applicant: FUJI ELECTRIC CO., LTD., Kanagawa (JP)

(72) Inventors: Kenji Fujita, Chiba (JP); Atsushi Kitabata, Mie (JP)

(73) Assignee: FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 16/386,509

(22) Filed: Apr. 17, 2019

(65) Prior Publication Data

US 2019/0242175 A1 Aug. 8, 2019

Related U.S. Application Data

(63) Continuation of application No. PCT/JP2017/039823, filed on Nov. 2, 2017.

(51) Int. Cl.
*E05F 15/635* (2015.01)
*B61D 19/02* (2006.01)
(Continued)

(52) U.S. Cl.
CPC ..... *E05F 15/635* (2015.01); *B61D 19/02* (2013.01); *E05B 81/08* (2013.01); *E05B 83/363* (2013.01); *E05B 83/40* (2013.01); *E05Y 2201/22* (2013.01)

(58) Field of Classification Search
CPC ..... B61D 19/02; B61D 19/005; E05F 15/635; E05F 15/632; E05Y 2900/51; E05Y 2201/22; E05B 65/0829
See application file for complete search history.

(56) References Cited

U.S. PATENT DOCUMENTS 3,745,705 A * 7/1973 Reddy ..... E05F 11/54 49/139
4,901,474 A * 2/1990 Bayard ..... E05F 15/565 292/144

(Continued)

FOREIGN PATENT DOCUMENTS

JP H11-165635 6/1999
JP 2002-357052 12/2002

(Continued)

OTHER PUBLICATIONS

International Search Report dated Jan. 23, 2018 with respect to No. PCT/JP2017/039823.

(Continued)

*Primary Examiner* — Justin B Rephann
(74) *Attorney, Agent, or Firm* — IPUSA, PLLC

(57) ABSTRACT

A door opening/closing device includes: an opening/closing bar attached to a door, which is actuated by a motor and is used for opening and closing the door; a door closing state detecting part configured to detect whether the door is in a closed state; a locking device configured to lock and unlock the door; a lock pin capable of being moved to a locked position or an unlocked position by the locking device; an engaging member attached to the opening/closing bar, which includes an engaging part configured to engage with the lock pin moved to the locked position; a first spring provided between the opening/closing bar and the engaging member; and a locking control unit configured to cause the locking device to lock the door when the closed state is detected by the door closing state detecting part.

5 Claims, 6 Drawing Sheets

(51) Int. Cl.

| | |
|---|---|
| ***E05B 83/40*** | (2014.01) |
| ***E05B 83/36*** | (2014.01) |
| ***E05B 81/08*** | (2014.01) |

(56) References Cited

U.S. PATENT DOCUMENTS

| | | | | |
|---|---|---|---|---|
| 5,148,631 | A * | 9/1992 | Bayard | E05F 15/565 49/370 |
| 5,483,769 | A * | 1/1996 | Zweili | B61D 19/008 49/118 |
| 5,755,060 | A * | 5/1998 | Zweili | E05B 65/0829 49/322 |
| 5,896,952 | A * | 4/1999 | Dohring | B66B 13/12 187/330 |
| 8,978,301 | B2 | 3/2015 | Ueda et al. | |
| 9,340,215 | B2 * | 5/2016 | Masuda | B61D 19/007 |
| 9,702,178 | B2 * | 7/2017 | Takayama | E05F 15/632 |
| 2003/0106457 | A1 * | 6/2003 | Inage | B61D 19/02 105/341 |
| 2003/0126797 | A1 | 7/2003 | Inage | |
| 2013/0340346 | A1 * | 12/2013 | Ueda | E05B 83/363 49/280 |
| 2014/0090301 | A1 * | 4/2014 | Takahashi | E05F 15/643 49/360 |
| 2015/0054294 | A1 * | 2/2015 | Uno | E05B 81/06 292/194 |
| 2016/0123047 | A1 | 5/2016 | Ueda et al. | |
| 2016/0229424 | A1 * | 8/2016 | Takayama | E05D 15/063 |

FOREIGN PATENT DOCUMENTS

| | | |
|---|---|---|
| JP | 2012-176708 | 9/2012 |
| JP | 2016-089406 | 5/2016 |
| WO | 2012/120790 | 9/2012 |

OTHER PUBLICATIONS

Written Opinion of the International Searching Authority dated Jan. 23, 2018 with respect to No. PCT/JP2017/039823.

* cited by examiner

DOOR OPENING/CLOSING DEVICE

CROSS-REFERENCE TO RELATED APPLICATION

This application is a continuation of International Application PCT/JP2017/039823 filed on Nov. 2, 2017 and designated the U.S., the entire contents of which are incorporated herein by reference.

BACKGROUND OF THE INVENTION

1. Field of the Invention

The present invention relates to a door opening/closing device.

2. Description of the Related Art

Conventionally, sliding door closing devices for cars have been proposed. For example, Patent Document 1 describes a door closing device for a sliding door that opens and closes linearly in a frame of a car. To the sliding door, a closing receiver and an opening receiver located in its opening direction are attached. The door closing device includes a drive protrusion on a motor for opening and closing the sliding door, which is provided between the closing receiver and the opening receiver. When the sliding door is in a closed state, the drive protrusion and the closing receiver are in contact and a gap X between the drive protrusion and the opening receiver is maintained. The door closing device also includes a sliding door side stopper fixed to the sliding door and a fixed side stopper attached to the frame. One of the stoppers is pre-loaded with respect to movement in "in and out directions" perpendicular to the opening and closing directions, and is configured to be able to engage with the other stopper. When the sliding door is in the closed state, the sliding door. side stopper is positioned in the door closing direction with a gap Y with respect to the fixed side stopper, and with the protrusion on the motor being provided, by a movement Z in the opening direction of this protrusion, one of the two stoppers movable in the in and out directions is moved in the "in" direction to release the engagement.

However, Patent Document 1 does not disclose a solution for making a person easily pull out an obstacle caught between sliding doors or between a sliding door and a frame, in a state in which the sliding doors are closed.

RELATED-ART DOCUMENTS

Patent Document

[Patent Document 1] Japanese Laid-Open Patent Publication No. 11-165635

SUMMARY OF THE INVENTION

A door opening/closing device according to an embodiment of the present invention includes an opening/closing bar attached to a door, the opening/closing bar being configured to be actuated by an electric motor, the door being opened and closed by the opening/closing bar being moved between an opened position and a closed position; a door closing state detecting part configured to detect whether the door is in a closed state; a locking device configured to lock and unlock the door; a lock pin configured to be moved to a locked position or an unlocked position by the locking device; an engaging member attached to the opening/closing bar, the engaging member including an engaging part configured to engage with the lock pin moved to the locked position, in a state in which the closed state is detected by the door closing state detecting part; a first spring provided between the opening/closing bar and the engaging member; and a locking control unit configured to issue a lock instruction to the locking device to cause the locking device to lock the door, in a case in which the opening/closing bar is moved to the closed position by the electric motor and in which the closed state is detected by the door closing state detecting part.

DETAILED DESCRIPTION OF THE PREFERRED EMBODIMENTS

In the following, an embodiment of a door opening/closing device of the present invention will be described.

Embodiment

Figure 1:
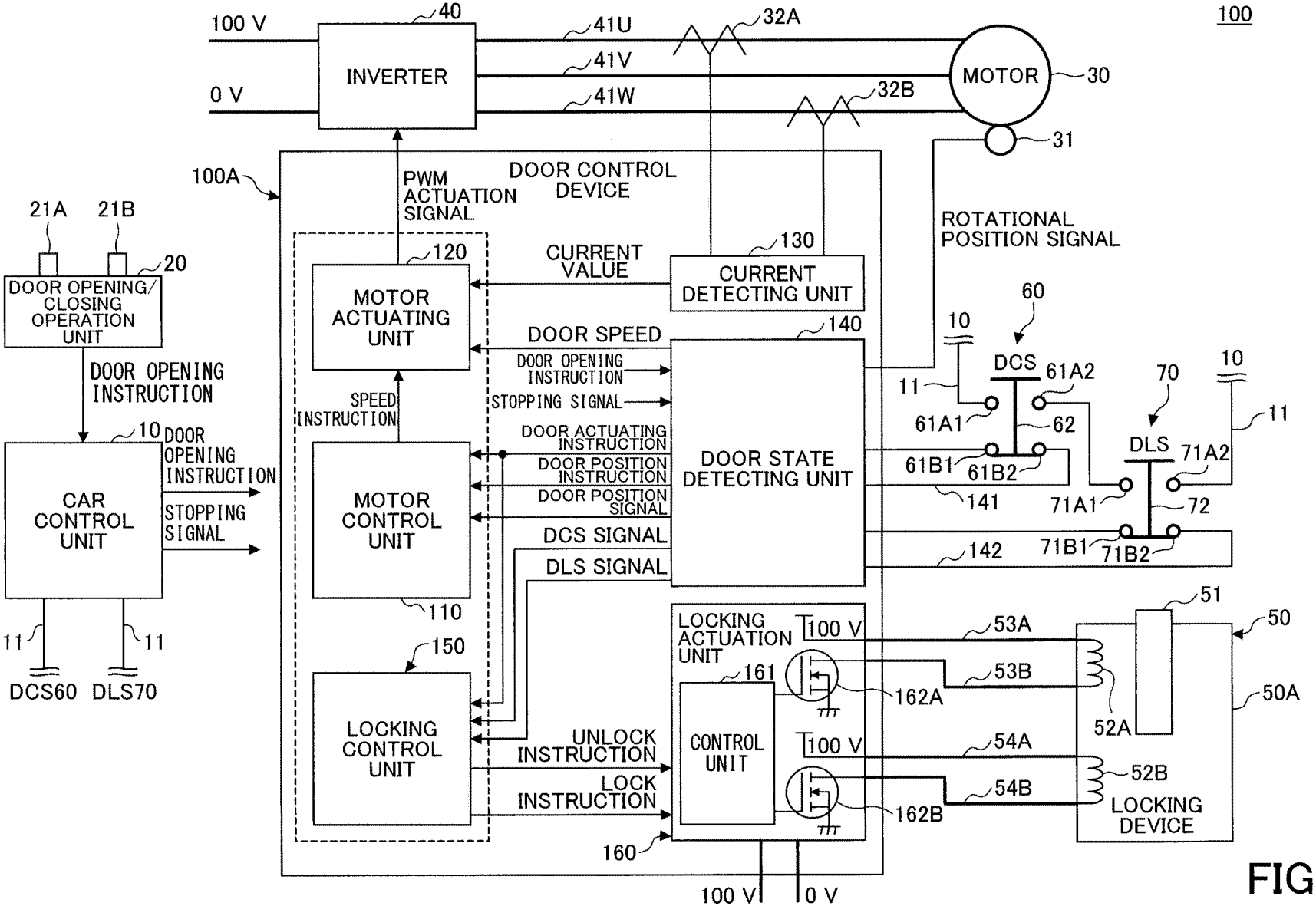
FIG. 1 is a diagram illustrating a circuit configuration of door equipment of a car.

FIG. 1 is a diagram illustrating a circuit configuration of door equipment of a car. The car to be exemplified in the present embodiment is a passenger car of a train operated by a railroad company or the like, and includes a door actuated by a motor 30. The train is not limited to an electric train, and any types of cars can be included in a scope of the present embodiment as long as the car includes a door actuated by a motor 30. In FIG. 1, illustration of a door is omitted.

A door opening/closing device 100 includes a car control unit 10, a door opening/closing operation unit 20, the motor 30, an encoder 31, current sensors 32A and 32B, an inverter 40, a locking device 50, a DCS (Door Close Switch) 60, a DLS (Door Lock Switch) 70, and a door control device 100A.

The car control unit 10 is an information processing device performing an operation control of a car. In a train composed of multiple cars being connected with each other, the car control unit 10 is provided in a driver's compartment in a first car and the like, and is also provided in a conductor's compartment in a rearmost car and the like. In addition to the door opening/closing operation unit 20, an operation lever and the like are connected to the car control unit 10, but description of these components are omitted in the present embodiment. In case of a car operable as a one-car train, the car control unit 10 is provided at a driver's compartment and a conductor's compartment which are respectively provided at both ends of the car in a travel direction of the car.

The car control unit 10 outputs, to the door control device 100A, a stopping signal indicating that the car is stopping, when the car is stopping at a station or the like. The car control unit 10 also outputs, to the door control device 100A, a door opening instruction entered from the door opening/closing operation unit 20.

Also, to the car control unit 10, a wire 11 for transmitting an interlock signal is connected. The DCS 60 and the DLS 70 are connected in a loop by the wire 11. When both the DCS 60 and the DLS 70 are in ON states, the interlock signal becomes a high (H) level, and the car can be started.

The door opening/closing operation unit 20 is equipped with an open switch 21A and a close switch 21B which are used for door opening/closing operations. When the open switch 21A is operated while the car is stopping, the door opening/closing operation unit 20 outputs a door opening instruction rising to a high (H) level to the car control unit 10. As a result, the door is opened. When the close switch 21B is operated, the door opening/closing operation unit 20 outputs a door opening instruction falling to a low (L) level to the car control unit 10. As a result, the door is closed. The door opening instruction falling to a low (L) level is an example of a closing instruction for closing door(s).

The motor 30 is a three-phase alternate current (AC) motor used for opening/closing the door. The door control device 100A performs driving control of the motor 30 via the inverter 40. The motor 30 is an example of an electric motor.

The encoder 31 detects a rotational position of the motor 30 by detecting a rotational angle of a rotational axis of the motor 30, and outputs a rotational position signal representing the rotational position to a door state detecting unit 140.

The current sensors 32A and 32B are provided at power cables 41U and 41W respectively, and detect magnitude of current of a U-phase and a W-phase respectively, among three-phase alternate current supplied from the inverter 40 to the motor 30 via the power cables 41U, 41V, and 41W. The magnitude of current (current values) detected by the current sensors 32A and 32B are input to a current detecting unit 130.

The inverter 40 converts direct-current (DC) power, which is supplied from a power supply unit in the car 1, to three-phase AC power, and supplies the three-phase AC power to the motor 30 via the power cables 41U, 41V, and 41W. An input side of the inverter 40 and an output side of the power supply unit are connected by two power cables. For example, DC power of 100 V is supplied to the inverter 40.

The locking device 50 is a device for locking the door of the car. The locking device 50 includes a pin 51, a coil 52A for unlocking, and a coil 52B for locking. The locking device 50 is implemented by a bi-directional self-holding solenoid. The coil 52A is connected to a locking actuation unit 160 via the wires 53A and 53B, and the coil 52B is connected to the locking actuation unit 160 via the wires 54A and 54B.

When the coil 52A is energized by the locking actuation unit 160, the locking device 50 causes the pin 51 to project from a chassis 50A of the locking device 50. As a result, because a lock pin of the door is moved, the door becomes unlocked. As the locking device 50 is of a self-holding type, the locking device 50 maintains the state in which the pin 51 projects from the chassis 50A even if energization of the coil 52A is stopped.

When the coil 52B is energized by the locking actuation unit 160, the locking device 50 retracts the pin 51 to an inside of the chassis 50A of the locking device 50. As a result, because the lock pin of the door is moved, the door becomes locked. While the car 1 is running, the door is being locked by the locking device 50. As the locking device 50 is of a self-holding type, the pin 51 maintains the state in which the pin 51 is retracted inside the chassis 50A even if energization of the coil 52B is stopped. Note that the pin 51 is not completely retracted inside the chassis 50A, and a tip of the pin 51 slightly projects from the chassis 50A.

The DCS 60 is a switch for detecting that the door of the car is being closed. For example, the DCS 60 is composed of a limit switch that is pushed by the door when the door has moved to a closed position. The DCS 60 is an example of a door closing state detecting part.

The DCS 60 includes terminals 61A1, 61A2, 61B1, and 61B2, and a movable contact 62. A set of the terminals 61A1 and 61A2 is inserted in series within the wire 11 for transmitting the interlock signal to the car control unit 10. A set of the terminals 61B1 and 61B2 is inserted in series within a wire 141 for transmitting a signal representing an ON state or OFF state of the DCS 60 to the door state detecting unit 140.

The movable contact 62 sets either the set of the terminals 61A1 and 61A2 or the set of the terminals 61B1 and 61B2 to a conducting state, by moving in a vertical direction in FIG. 1. When the limit switch in the DCS 60 is pushed by the door, the terminals 61A1 and 61A2 become in the conducting state by the movable contact 62, and the DCS 60 is set to an ON state. When the limit switch is not pushed by the door, the terminals 61B1 and 61B2 become in the conducting state by the movable contact 62 as illustrated in FIG. 1, and the DCS 60 is set to an OFF state. The ON state of the DCS 60 represents a state in which the door is completely closed.

The DLS 70 is a switch for detecting that the door of the car is locked. The DLS 70 is composed of a limit switch that is pushed by the lock pin of the door when the lock pin is moved to a locked position by the pin 51 of the locking device 50 being retracted inside the chassis 50A.

The DLS 70 includes terminals 71A1, 71A2, 71B1, and 71B2, and a movable contact 72. A set of the terminals 71A1 and 71A2 is inserted in series within the wire 11 for transmitting the interlock signal to the car control unit 10. A set of the terminals 71B1 and 71B2 is inserted in series within a wire 142 for transmitting a signal representing an ON state or OFF state of the DLS 70 to the door state detecting unit 140.

The movable contact 72 sets either the set of the terminals 71A1 and 71A2 or the set of the terminals 71B1 and 71B2 to a conducting state, by moving in a vertical direction in FIG. 1. When the limit switch in the DLS 70 is pushed by the lock pin, the terminals 71A1 and 71A2 become in the conducting state by the movable contact 72, and the DLS 70 is set to an ON state. When the limit switch is not pushed by the lock pin, the terminals 71B1 and 71B2 become in the conducting state by the movable contact 72 as illustrated in FIG. 1, and the DLS 70 is set to an OFF state.

In a case in which the pin 51 of the locking device 50 is projecting from the chassis 50A, the DLS 70 does not detect whether or not the door is locked, and the DLS 70 remains in an OFF state. When the pin 51 of the locking device 50 is retracted inside the chassis 50A and the door becomes locked, the DLS 70 is set to an ON state.

When the DCS 60 is turned on (that is, the door is closed) and the DLS 70 is turned on (that is, the door is locked), the interlock signal becomes a high (H) level.

The door control device 100A includes a motor control unit 110, a motor actuating unit 120, the current detecting unit 130, the door state detecting unit 140, a locking control unit 150, and the locking actuation unit 160. A set of the motor control unit 110, the motor actuating unit 120, and the locking control unit 150, which is surrounded by a broken line in FIG. 1, can be embodied by an information processing unit such as a CPU (Central Processing Unit) chip.

The motor control unit 110 generates a speed instruction for driving the motor 30 based on a door actuating instruction and door position instruction entered from the door state detecting unit 140. The speed instruction is output to the motor actuating unit 120. The door actuating instruction represents to which direction (a door-opening direction or a door-closing direction) the motor 30 is to be driven, and represents how fast the motor 30 is to be driven. The motor control unit 110 determines a rotating direction and a speed pattern of the motor 30 based on the door actuating instruction.

The speed instruction is an instruction for controlling speed of the motor 30. When the door is started to be closed, speed represented by the speed instruction is set high. When the door is closed to a certain degree, speed represented by the speed instruction is set low. Switching of the speed instruction between high-speed and low-speed is performed by the motor control unit 110 in accordance with a position of the door represented by a door position signal to be described below. Also, when the DLS 70 is turned on, the motor control unit 110 sets speed represented by the speed instruction to zero, and the motor 30 is stopped (the motor 30 becomes a state not being actuated).

The motor actuating unit 120 generates a PWM (Pulse Width Modulation) driving signal for driving the motor 30, based on the speed instruction entered from the motor control unit 110, current value entered from the current detecting unit 130, and door speed entered from the door state detecting unit 140. The PWM driving signal is output to the inverter 40. A duty ratio of the PWM driving signal is configured such that door speed becomes equal to the speed represented by the speed instruction.

The current detecting unit 130 outputs data representing current values detected by the current sensors 32A and 32B, to the motor actuating unit 120. In FIG. 1, the data representing current values is illustrated as a single line. However, data representing a current value detected by the current sensor 32A and data representing a current value detected by the current sensor 32B are output to the motor actuating unit 120 separately.

The door state detecting unit 140 generates the door actuating instruction represented by a logical disjunction of the door opening instruction and the stopping signal, both of which are entered from the car control unit 10. The door actuating instruction is output to the motor control unit 110. The door actuating instruction represents to which direction (a door-opening direction or a door-closing direction) the motor 30 is to be driven, and represents how fast the motor 30 is to be driven.

Also, the door state detecting unit 140 converts a rotational position of the motor 30 entered from the encoder 31 into a position of the door in an opening/closing direction, and outputs a door position signal representing the position of the door to the motor control unit 110.

The door state detecting unit 140 also detects an ON state or OFF state of the DCS 60 and an ON state or OFF state of the DLS 70, via the wires 141 and 142. When the DCS 60 is in an OFF state, the door state detecting unit 140 outputs a DCS signal of a low (L) level. When the DCS 60 is in an ON state, the door state detecting unit 140 outputs a DCS signal of a high (H) level. The DCS signal is input to the locking control unit 150.

When the DLS 70 is in an OFF state, the door state detecting unit 140 outputs a DLS signal of a low (L) level. When the DLS 70 is in an ON state, the door state detecting unit 140 outputs a DLS signal of a high (H) level. The DLS signal is input to the locking control unit 150.

To the locking control unit 150, the door actuating instruction, the DCS signal, and the DLS signal are entered from the door state detecting unit 140. When the DCS 60 is turned on, the locking control unit 150 outputs a lock instruction to the locking actuation unit 160. As a result, the locking device 50 is locked by the locking actuation unit 160.

When a door actuating instruction indicating opening the door is input to the locking control unit 150, the locking control unit 150 outputs an unlock instruction to the locking actuation unit 160. As a result, the locking device 50 is unlocked by the locking actuation unit 160.

The locking actuation unit 160 includes a control unit 161 and MOSFETs (Metal Oxide Semiconductor Field Effect Transistors) 162A and 162B. The wires 53A, 53B, 54A, and 54B are connected to output terminals of the locking actuation unit 160. For example, DC power of 100 V is supplied to the locking actuation unit 160, similar to the inverter 40, and the locking actuation unit 160 supplies the DC power of 100 V to the wires 53A and 54A.

The MOSFET 162A is an N-channel MOSFET; a gate is connected to the control unit 161, a drain is connected to the wire 53B, and a source is grounded. Similarly, the MOSFET 162B is an N-channel MOSFET; a gate is connected to the control unit 161, a drain is connected to the wire 54B, and a source is grounded.

Based on the lock instruction and the unlock instruction entered from the locking control unit 150, the locking actuation unit 160 drives the MOSFETs 162A and 162B. When a high (H) level unlock instruction is received, the locking actuation unit 160 turns on the MOSFET 162A. As a result, the coil 52A is energized, the pin 51 is projected, and the locking device 50 is unlocked. When a high (H) level lock instruction is received, the locking actuation unit 160 turns on the MOSFET 162B. As a result, the coil 52B is energized, the pin 51 is retracted, and the locking device 50 is locked.

Figure 2A:
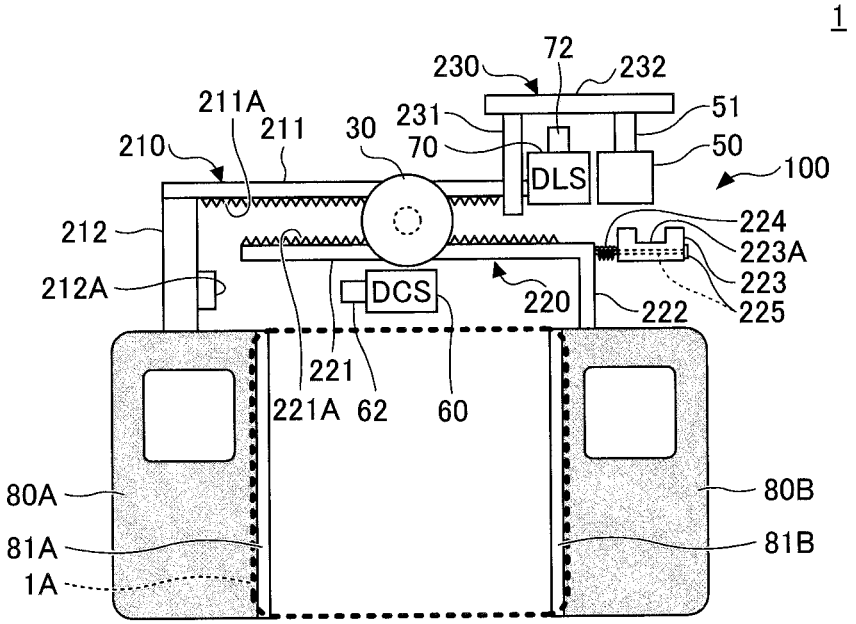
FIGS. 2A and 2B are diagrams illustrating configurations of doors and their peripheral components, of a car including a door opening/closing device according to an embodiment.
Figure 2B:
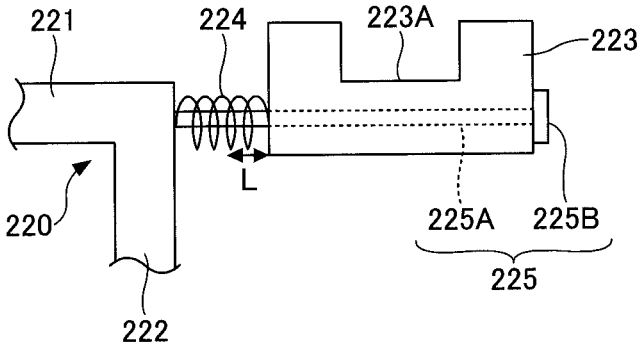

FIGS. 2A and 2B are diagrams illustrating configurations of doors 80A and 80B and their peripheral components of the car 1 including the door opening/closing device 100 according to the present embodiment. In FIG. 2A, a state in which the doors 80A and 80B are fully opened and the locking device 50 is unlocked is illustrated. An enlarged view of a part of FIG. 2A is illustrated in FIG. 2B.

The doors 80A and 80B are bi-parting sliding doors provided at an opening 1A of the car 1. Door leading edge rubbers 81A and 81B are respectively provided at portions of the doors 80A and 80B that come into contact with each other. At the portions of the doors 80A and 80B that come into contact with each other, the door leading edge rubbers 81A and 81B are attached between the lower end and the upper end of the doors 80A and 80B. The motor 30 is provided above the doors 80A and 80B. The DCS 60 is provided under the motor 30.

An upper rack 210 is attached to the door 80A, and a lower rack 220 is attached to the door 80B.

The upper rack 210 is an L-shaped member including a rack portion 211 and a connection portion 212. The rack portion 211 is a bar-shaped member extending in a horizontal direction, and a rack 211A is provided at a bottom surface of the upper rack portion 211. As the rack portion 211 and the connection portion 212 are connected in an L shape, upon rotating the motor 30, the upper rack 210 is moved to the right or the left, and the door 80A moves in the door-closing direction (right) or the door-opening direction (left).

The rack 211A is engaged with a pinion gear that is driven by the motor 30. The connection portion 212 is a bar-shaped member for connecting the upper rack 210 to the upper end of the door 80A. A contact portion 212A is provided on the lower side surface (the right side surface in FIG. 2A) of the connection portion 212. When the doors 80A and 80B are closed, the contact portion 212A comes into contact with the movable contact 62 of the DCS 60 and presses the movable contact 62. As a result, the DCS 60 is turned on.

The lower rack 220 includes a rack portion 221, a connection portion 222, and an engaging member 223, a spring 224, and a supporting bar 225. The lower rack 220 is a member attached to the door 80B.

The rack portion 221 is a bar-shaped member extending in the horizontal direction, and the rack 221A is provided at an upper surface of the rack portion 221. The rack portion 221 is an example of an opening/closing bar. The rack 221A is engaged with the pinion gear driven by the motor 30. Therefore, upon rotating the motor 30, the lower rack 220 is moved to the right or the left, and the door 80B moves in the door-opening direction (right) or the door-closing direction (left). The engaging member 223 is attached to a right edge of the rack portion 221, via the spring 224 and the supporting bar 225.

The connection portion 222 is a bar-shaped member for connecting the lower rack 220 to the upper end of the door 80B. By the rack portion 221 and the connection portion 222, an L-shaped member is formed.

The engaging member 223 is attached to the right edge of the rack portion 221, via the spring 224 and the supporting bar 225. A rack is not provided at an upper surface of the engaging member 223, but a lock hole 223A is provided. The engaging member 223 is a C-shaped member.

The lock hole 223A is a recess having an opening on the upper surface of the engaging member 223. When the doors 80A and 80B are locked, a lower end of a pin portion 231 of a lock pin 230 is inserted into the lock hole 223A.

The spring 224 is provided between the right edge of the rack portion 221 and a left end of the engaging member 223, with the spring 224 fitted with respect to the supporting bar 225 coaxially. The spring 224 is fitted with respect to the supporting bar 225 in a state contracted from a natural unloaded length. The spring 224 can further contract by a predetermined length L. The spring 224 is an example of a first spring.

An elastic force of the spring 224 is set such that a person can relatively easily pull out an obstacle (for example, personal belongings of the person such as a bag and an umbrella) caught between the door leading edge rubbers 81A and 81B when the doors 80A and 80B have been closed, even if the lower end of the pin portion 231 is inserted into the lock hole 223A.

The supporting bar 225 includes a bar portion 225A and a lock portion 225B. A left end of the bar portion 225A is fixed to the right edge of the rack portion 221, and the lock portion 225B is provided at a right end of the bar portion 225A. The spring 224 is inserted to an outer circumference of the bar portion 225A. A thickness of the bar portion 225A is designed such that the bar portion 225A can fit in an inner diameter of a through hole of the engaging member 223 formed in the horizontal direction. By contracting the spring 224, the engaging member 223 can move to the left with respect to the bar portion 225A. As the engaging member 223 is stopped by the lock portion 225B of greater extent than the bar portion 225A at a right end, the engaging member 223 is prevented from being pulled off from the supporting bar 225.

The lock pin 230 includes the pin portion 231 extending in a vertical direction and an extending portion 232 extending in the horizontal direction. The extending portion 232 is connected to an upper portion of the pin portion 231. When the locking device 50 is unlocked and the pin 51 protrudes upward, the extending portion 232 is raised upward. This state is an unlocked position of the lock pin 230.

When the lock pin 230 is in the unlocked position, a bottom end of the pin portion 231 is positioned over the engaging member 223. Thus, in this state, the pin portion 231 does not engage with the lock hole 223A. As the bottom end of the pin portion 231 is positioned over an upper end of the engaging member 223, the doors 80A and 80B can move in a lateral direction (door-opening/closing direction).

When the locking device 50 is locked and the pin 51 is retracted, with the doors 80A and 80B fully closed, the extending portion 232 moves downward and the bottom end of the pin portion 231 engages with the lock hole 223A. As a result, the doors 80A and 80B are locked. This state is a locked position of the lock pin 230.

Figure 3A:
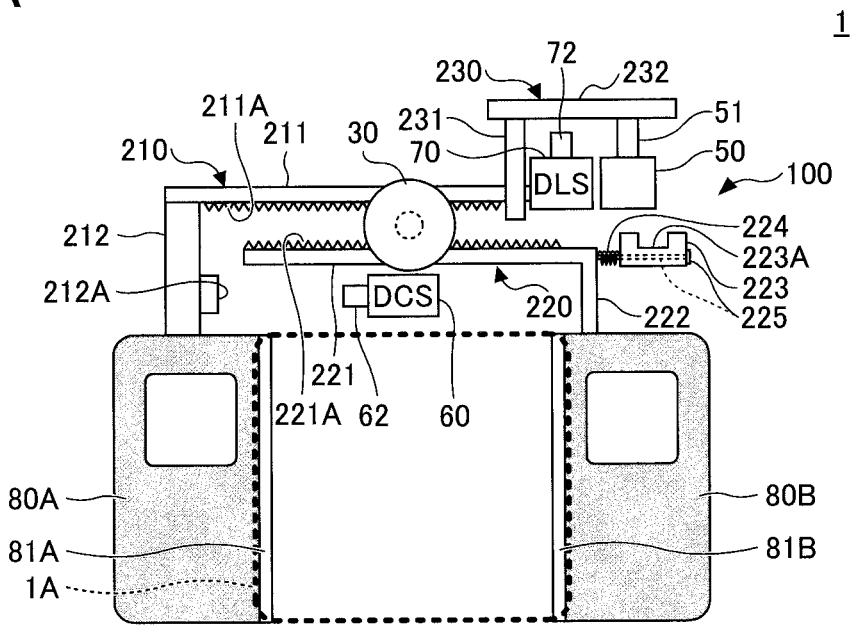
FIGS. 3A and 3B are diagrams illustrating configurations and operations of the doors and their peripheral components, of the car including the door opening/closing device according to the embodiment.

FIGS. 3A to 4C are diagrams illustrating configurations and operations of the doors 80A and 80B and their peripheral components of the car 1 including the door opening/closing device 100 according to the present embodiment. A state illustrated in FIG. 3A is the same as that illustrated in FIG. 2A. Here, behavior of the door opening/closing device 100 will be described, when the doors 80A and 80B are gradually closed as illustrated in FIG. 3B, FIGS. 4A, 4B, and 4C, from a state illustrated in FIG. 3A in which the doors 80A and 80B are fully opened and the locking device 50 is unlocked.

Figure 3B:
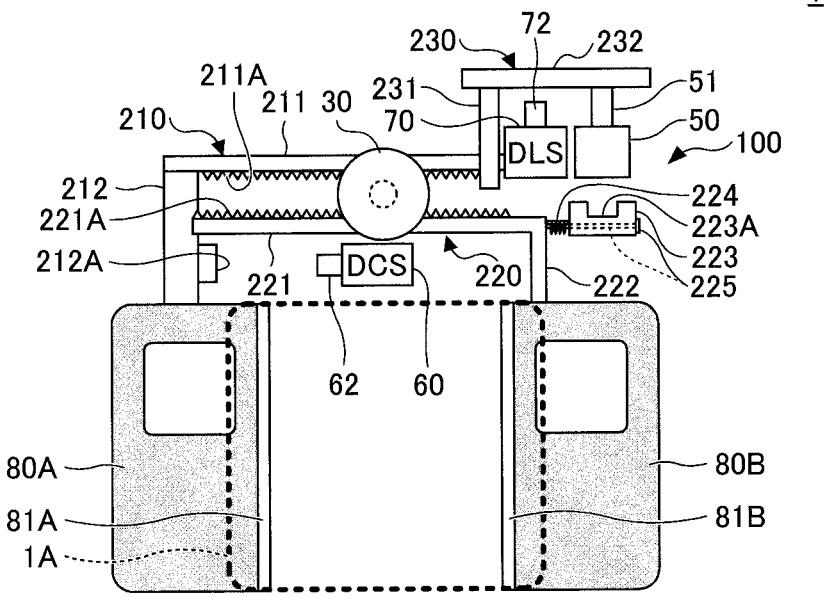
Figure 4A:
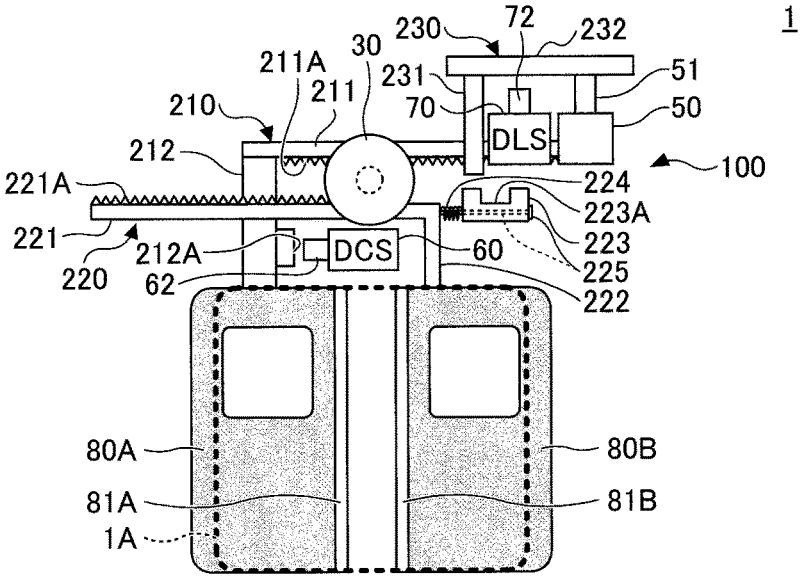
FIGS. 4A, 4B, and 4C are diagrams illustrating configurations and operations of the doors and their peripheral components, of the car including the door opening/closing device according to the embodiment.
Figure 4B:
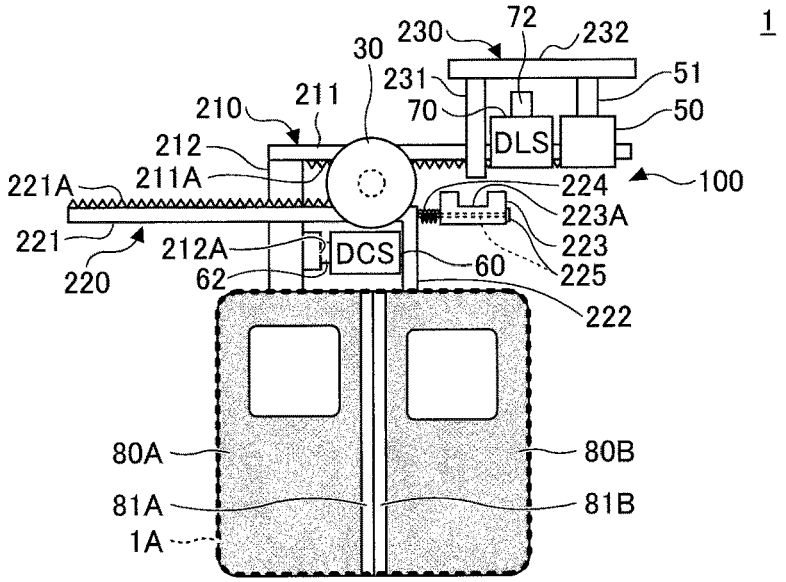

When the doors 80A and 80B, in a fully opened state as illustrated in FIG. 3A, are gradually closed by the motor 30 being rotated in a direction of closing the doors 80A and 80B, the doors 80A and 80B become closed as illustrated in FIG. 4B, through states illustrated in FIG. 3B and FIG. 4A.

In the states illustrated in FIG. 3B and FIG. 4A, both the DCS 60 and the DLS 70 are in OFF states. When the doors 80A and 80B are fully closed as illustrated in FIG. 4B, the contact portion 212A comes into contact with the movable contact 62 of the DCS 60. Thus, as the movable contact 62 is pressed, the DCS 60 is turned on. However, in the state of FIG. 4B, the locking device 50 is an unlocked state, and the DLS 70 is in an OFF state.

In the door control device 100A, when the DCS 60 is turned on, the locking control unit 150 outputs a lock instruction to the locking actuation unit 160 to lock the locking device 50. Thereafter, the motor 30 is set to a state in which the motor 30 is not driven, by setting a speed instruction to zero. The speed instruction is issued after the locking device 50 is locked by the lock instruction output to the locking actuation unit 160.

Figure 4C:
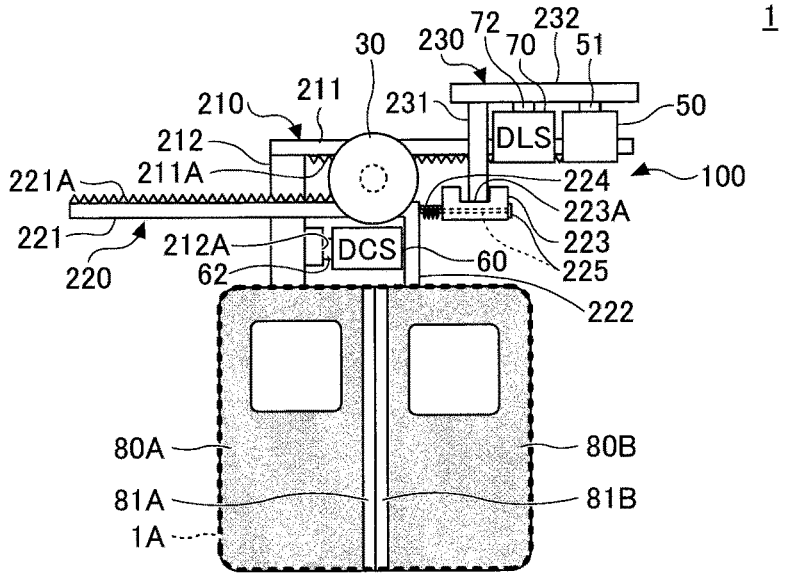

When the locking device 50 is locked by the locking actuation unit 160, the pin 51 is retracted inside the chassis 50A, and the movable contact 72 of the DLS 70 is pushed by the lock pin 230 moving downward. Thus, as illustrated in FIG. 4C, the DLS 70 is turned on.

Here, behavior of the door opening/closing device 100 in a case in which the lower end of the pin portion 231 has been inserted into the lock hole 223A when the doors 80A and 80B were closed, while an obstacle (for example, personal belongings of a user such as a bag and an umbrella) is caught between the door leading edge rubbers 81A and 81B, will be described. When the user attempts to pull out an obstacle, or when the user attempts to open the doors 80A and 80B, the spring 224 can contract by the predetermined length L. An elastic force of the spring 224 is set such that the user can relatively easily pull out an obstacle caught between the door leading edge rubbers 81A and 81B.

Therefore, even if the lower end of the pin portion 231 has been inserted into the lock hole 223A when the doors 80A and 80B were closed, while an obstacle (for example, personal belongings of a user such as a bag and an umbrella) is caught between the door leading edge rubbers 81A and 81B, the user can relatively easily pull out the obstacle.

In the door opening/closing device 100, by providing the spring 224 between the rack portion 221 and the engaging member 223 of the lower rack 220 attached to the door 80B, the door 80B can be moved by the predetermined length L in the door-opening direction even if an obstacle has been caught between the door leading edge rubbers 81A and 81B when the doors 80A and 80B were closed.

In order that a user can relatively easily pull out an obstacle having been caught between the door leading edge rubbers 81A and 81B when the doors were closed, the door opening/closing device 100 is configured as described above.

Accordingly, the door opening/closing device 100 that makes a person easily pull out an obstacle can be provided.

Also, as an obstacle can be pulled out while the locking device 50 is being locked, a frequency of performing an operation for unlocking the locking device 50 and opening the doors 80A and 80B again can be reduced. Thus, during rush hours for example, the car 1 can start early, and delay of the car 1 from a given schedule can be suppressed.

Accordingly, the door opening/closing device 100 according to the present embodiment can not only enable a person to easily pull out an obstacle, but also realize a quick operation.

In the above description, an operation control of the bi-parting sliding doors 80A and 80B has been discussed. However, an operation control of a single sliding door may be performed.

Further, as illustrated in FIGS. 5A to 6C, the door opening/closing device 100 may be modified to a door opening/closing device 100M equipped with locking devices 50M1 and 50M2 instead of the locking device 50 illustrated in FIGS. 2A to 4C.

FIGS. 5A to 6C are diagrams illustrating configurations and operations of the doors 80A and 80B and their peripheral components of the car 1 including the door opening/closing device 100M according to a modified example of the present embodiment. The door opening/closing device 100M includes a lock pin 230M instead of the lock pin 230 of the door opening/closing device 100 illustrated in FIGS. 2A to 4C, and includes the locking devices 50M1 and 50M2 instead of the locking device 50 of the door opening/closing device 100 illustrated in FIGS. 2A to 4C. The locking device 50M1 is provided at the same location as a location of the locking device 50 illustrated in FIGS. 2A to 4C, but the locking device 50M1 is different from the locking device 50 in that the locking device 50M1 is not of a self-holding type. The locking device 50M2 is of a self-holding type, and is implemented by a bi-directional self-holding solenoid.

First, a configuration of the door opening/closing device 100M will be described with reference to FIG. 5A. Among components in the door opening/closing device 100M, with respect to components that are the same as or comparable to components of the door opening/closing device 100, the same reference symbols are assigned, and descriptions of the components are omitted.

The lock pin 230M includes a pin portion 231, an extending portion 232, and a spring 233. That is, the lock pin 230M is structured by adding the spring 233 to the lock pin 230 illustrated in FIGS. 2A to 4C. The spring 233 is an example of a second spring.

The spring 233 is provided between an upper surface of the extending portion 232 and a wall portion 1B. When the locking device 50M1 is unlocked and the lock pin 230M is in an unlocked position as illustrated in FIG. 5A, the spring 233 is in a state contracted from a natural unloaded length. When the lock pin 230M is in a locked position, the spring 233 is in a state of a natural unloaded length, or in a state contracted from a natural unloaded length. Note that the wall portion 1B is a structure located above the doors 80A and 80B of the car 1. For example, the wall portion 1B is a part of a body of the car 1.

The locking device 50M2 is an actuator provided near a right end of the extending portion 232. A configuration of the locking device 50M2 is similar to that of the locking device 50 of the door opening/closing device 100 illustrated in FIGS. 2A to 4C, and the locking device 50M2 can cause the pin 51M2 to be projected and can retract the pin 51M2. The locking device 50M2 is disposed over the doors 80A and 80B of the car 1, and is fixed to the body.

The locking device 50M2 interoperates with the locking device 50M1, and operates in the following manner. As the locking device 50M1 interoperates with the locking device 50M2, an operation of the locking device 50M1 is slightly different from that of the locking device 50 of the door opening/closing device 100 illustrated in FIGS. 2A to 4C.

The locking devices 50M1 and 50M2 function as a single locking device for performing locking and unlocking operations of the doors 80A and 80B. The locking device 50M1 is an example of a first locking unit, and the locking device 50M2 is an example of a second locking unit. Further, a pin 51M1 of the locking device 50M1 is an example of a first pin, and the pin 51M2 of the locking device 50M2 is an example of a second pin.

A position of the pin 51M1 of the locking device 50M1 when the pin 51M1 is projected is an example of a first projected position, and a position of the pin 51M1 retracted in the locking device 50M1 is an example of a first retracted position. A position of the pin 51M2 of the locking device 50M2 when the pin 51M2 is projected is an example of a second projected position, and a position of the pin 51M2 retracted in the locking device 50M2 is an example of a second retracted position.

When the locking control unit 150 outputs an unlock instruction, the pin 51M1 of the locking device 50M1 raises the lock pin 230M from the locked position to the unlocked position by moving the pin 51M1 from the first retracted position to the first projected position. Thereafter, the pin 51M2 of the locking device 50M2 holds the lock pin 230M at the unlocked position from a horizontal direction, by moving the pin 51M2 from the second retracted position to the second projected position. When the lock pin 230M is raised to the unlocked position, the spring 233 is contracted.

Also, when the pin 51M2 begins holding the lock pin 230M at the unlocked position, the pin 51M1 of the locking device 50M1 moves from the first projected position to the first retracted position.

Next, behavior of the door opening/closing device 100M will be described, when the doors 80A and 80B are gradually closed as illustrated in FIG. 5B, FIGS. 6A, 6B, and 6C, from a state illustrated in FIG. 5A in which the doors 80A and 80B are fully opened and the locking device 50M1 is unlocked.

Figure 5A:
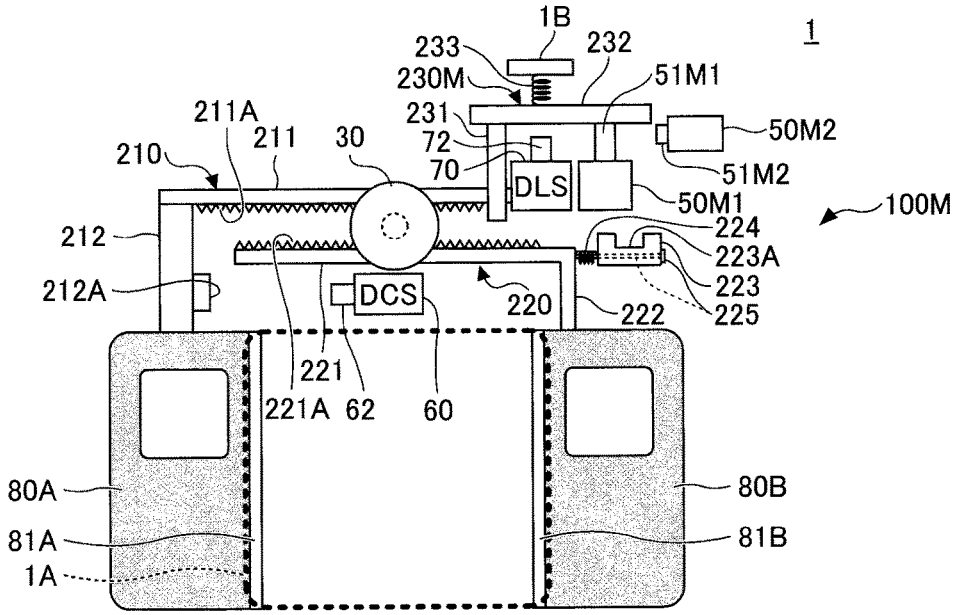
FIGS. 5A and 5B are diagrams illustrating configurations of doors and their peripheral components, of a car including a door opening/closing device according to a modified example of the embodiment.

The state illustrated in FIG. 5A corresponds to the state illustrated in FIG. 2A, in which the pin 51M1 of the locking device 50M1 is raising the lock pin 230M to the unlocked position. At this time, the locking device 50M2 is in a state in which the pin 51M2 is retracted in the locking device 50M2, and the spring 233 is in a contracted state. Also, the doors 80A and 80B are in a fully opened state.

When the close switch 21B is operated at this state, the door opening/closing operation unit 20 outputs, to the car control unit 10, a door opening instruction falling to a low (L) level. The car control unit 10 outputs a door opening instruction falling to a low (L) level to the door control device 100A.

When the door control device 100A receives the door opening instruction falling to a low (L) level, the door control device 100A rotates the motor 30 in a direction of closing the doors 80A and 80B that are in a fully opened state as illustrated in FIG. 5A. As a result, the doors 80A and 80B are gradually closed. When the doors 80A and 80B become a state illustrated in FIG. 5B, the pin 51M2 of the locking device 50M2 is projected and holds the right end of the extending portion 232. Thereafter, the pin 51M1 of the locking device 50M1 is retracted. The lock pin 230M is held at the unlocked position by the locking device 50M2.

Figure 5B:
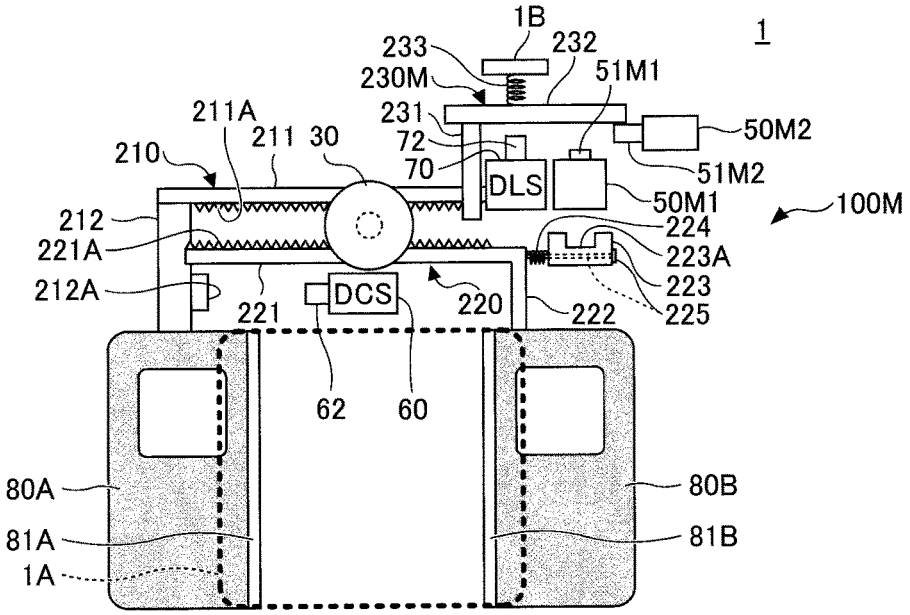

Note that both the DCS 60 and the DLS 70 are in OFF states at the state illustrated in FIG. 5B.

Figure 6A:
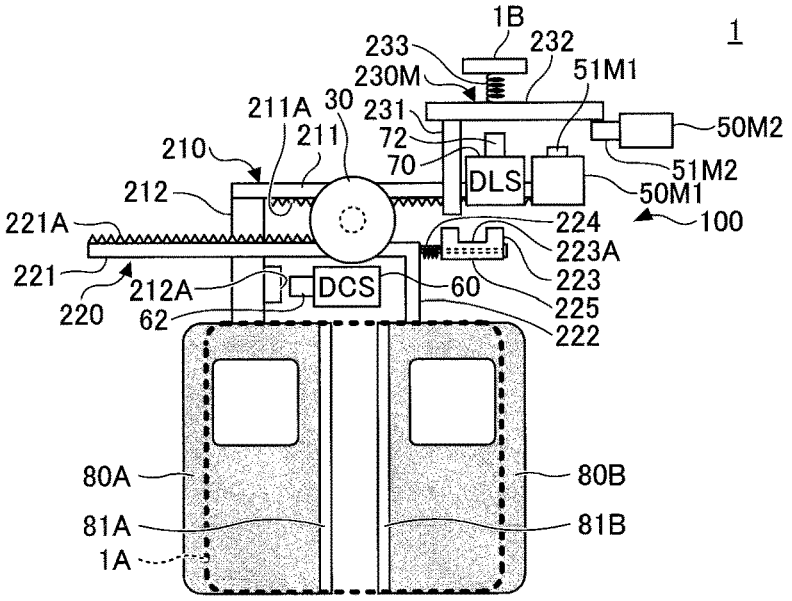
FIGS. 6A, 6B, and 6C are diagrams illustrating configurations and operations of the doors and their peripheral components, of the car including the door opening/closing device according to the modified example of the embodiment.

When the doors 80A and 80B are further closed from the state in FIG. 5B and the doors 80A and 80B become a state before a fully closed state, the locking device 50M2 maintains a state in which the pin 51M2 of the locking device 50M2 is projected and holds the right end of the extending portion 232, and the locking device 50M1 maintains a state in which the pin 51M1 of the locking device 50M1 is retracted, as illustrated in FIG. 6A. Both the DCS 60 and the DLS 70 are in OFF states at the state of FIG. 6A.

Figure 6B:
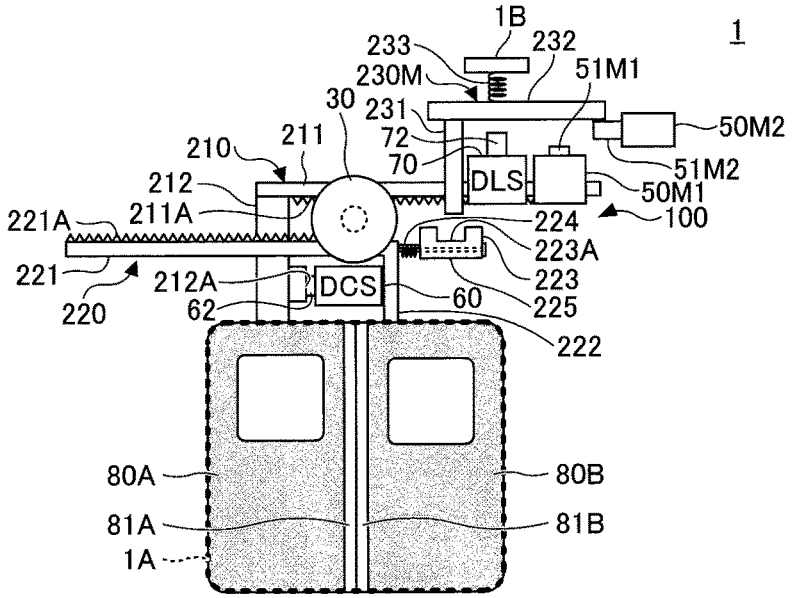

When the doors 80A and 80B are fully closed as illustrated in FIG. 6B, the contact portion 212A comes into contact with the movable contact 62 of the DCS 60 and presses the movable contact 62. As a result, the DCS 60 is turned on. However, at the state of FIG. 6B, the lock pin 230M is in a state of being held at the unlocked position by the locking device 50M2, and the DLS 70 is in an OFF state. Also, the spring 233 is in a contracted state.

When the DCS 60 is turned on, the door control device 100A causes the locking control unit 150 to output a lock instruction to the locking actuation unit 160, and causes the motor control unit 110 to output a speed instruction representing zero in order not to drive the motor 30. The speed instruction is issued after the locking device 50M1 is locked by the lock instruction output to the locking actuation unit 160.

Figure 6C:
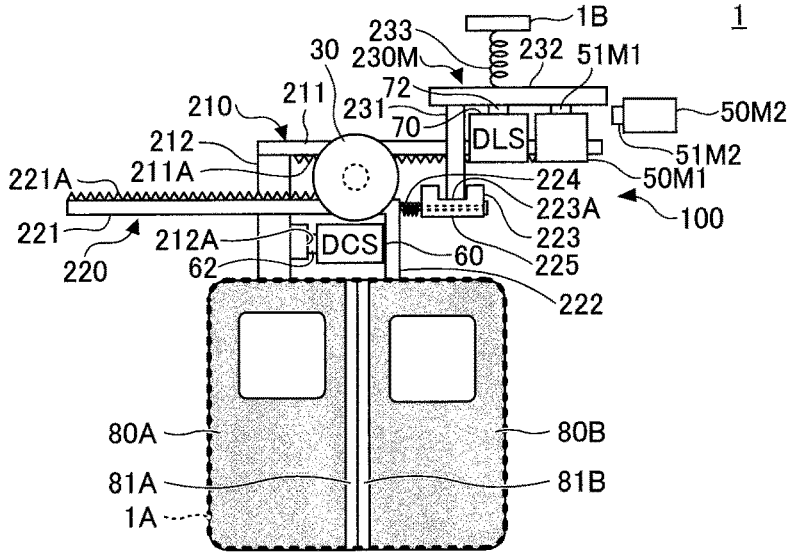

When the pin 51M2 of the locking device 50M2 is retracted by the locking actuation unit 160, the lock pin 230M is moved down to the locked position by a restoring force of the spring 233, the movable contact 72 of the DLS 70 is pushed by the lock pin 230M, and the DLS 70 is turned on, as illustrated in FIG. 6C.

Similar to the door opening/closing device 100 illustrated in FIGS. 2A to 4C, behavior of the door opening/closing device 100M in a case in which the lower end of the pin portion 231 has been inserted into the lock hole 223A when the doors 80A and 80B were closed, while an obstacle (for example, personal belongings of a user such as a bag and an umbrella) is caught between the door leading edge rubbers 81A and 81B, will be described. When the user attempts to pull out an obstacle, or when the user attempts to open the doors 80A and 80B, the spring 224 can contract by the predetermined length L. An elastic force of the spring 224 is set such that the user can relatively easily pull out an obstacle caught between the door leading edge rubbers 81A and 81B.

Therefore, even if an obstacle (for example, personal belongings of a user such as a bag and an umbrella) has been caught between the door leading edge rubbers 81A and 81B when the doors 80A and 80B were closed, the user can relatively easily pull out the obstacle.

Also, as an obstacle can be pulled out while the locking device 50M1 is being locked, a frequency of performing an operation for opening the doors 80A and 80B again can be reduced. Thus, during rush hours for example, the car 1 can start early, and delay of the car 1 from a given schedule can be suppressed.

Accordingly, the door opening/closing device 100M according to the modified example can not only enable a person to easily pull out an obstacle, but also realize a quick operation.

Also, according to the door opening/closing device 100M, the lock pin 230M can be moved to the locked position by using a restoring force of the spring 233, not by a weight of the lock pin 230M itself.

When the lock pin 230M is raised from the locked position to the unlocked position, the lock pin 230M is held at the unlocked position by the pin 51M2 of the locking device 50M2 from the horizontal direction, by moving the pin 51M2 from the second retracted position to the second projected position. Also, the pin 51M1 of the locking device 50M1 moves from the first projected position to the first retracted position. Energy such as electric power is not required for holding the lock pin 230M at the unlocked position by the pin 51M2 of the locking device 50M2 from a horizontal direction. This is because the state described here is a state in which the pin 51M2 of the self-holding type locking device 50M2 has been moved to the second projected position.

Therefore, as the lock pin 230M can be held at the unlocked position by the pin 51M2 of the locking device 50M2 projecting from a horizontal direction without continuing to cause the pin 51M1 of the locking device 50M1 to be projected, the lock pin 230M can be maintained at the unlocked position without consuming electricity in the locking device 50M1 and the locking device 50M2.

The above description regarding FIGS. 5A to 6C explains a sequence of operations performed when the doors 80A and 80B are gradually closed and are transited from a fully opened state to a state illustrated in FIG. 5B, in which the pin 51M2 of the locking device 50M2 is projected, the right end of the extending portion 232 is held by the pin 51M2, the pin 51M1 of the locking device 50M1 is retracted, and thereby the lock pin 230M is held at the unlocked position by the locking device 50M2. However, the operations are not necessarily performed only when the close switch 21B is operated. Operations of the locking devices 50M1 and 50M2 and an operation of the lock pin 230M being held at an unlocked position may be performed before the doors 80A and 80B becomes a state illustrated in FIG. 5A. These operations may be performed when, for example, the open switch 21A is operated and the door opening/closing operation unit 20 outputs a door opening instruction rising to a high (H) level to the car control unit 10.

Although the door opening/closing devices according to exemplary embodiments have been described above, the present invention is not limited to the embodiments specifically disclosed, and various variations and modifications may be made without departing from the scope of the claims.

What is claimed is:

1. A door opening/closing device comprising:

an opening/closing bar attached to a door, the opening/closing bar being configured to be actuated by an electric motor, the door being opened and closed by the opening/closing bar being moved between an opened position and a closed position;

a door closing state detecting part configured to detect whether the door is in a closed state;

a locking device configured to lock and unlock the door;

a lock pin configured to be moved to a locked position or an unlocked position by the locking device;

an engaging member attached to the opening/closing bar, the engaging member including an engaging part configured to engage with the lock pin moved to the locked position, in a state in which the closed state is detected by the door closing state detecting part;

a first spring provided between the opening/closing bar and the engaging member; and a locking control unit configured to issue a lock instruction to the locking device to cause the locking device to lock the door, in a case in which the opening/closing bar is moved to the closed position by the electric motor and in which the closed state is detected by the door closing state detecting part.

2. The door opening/closing device according to claim 1, wherein an elastic force of the first spring is set such that a user can pull out an obstacle caught between the door and another door or a frame.

3. The door opening/closing device according to claim 1, wherein the first spring can contract to a given length such that a user can pull out an obstacle caught between the door and another door or a frame.

4. The door opening/closing device according to claim 1, further comprising a second spring, wherein the second spring contracts when the lock pin is in the unlocked position, and the second spring moves the lock pin to the locked position by a restoring force of the second spring.

5. The door opening/closing device according to claim 4, further comprising a first locking unit including a first pin movable between a first projected position and a first retracted position, the first locking unit being configured to raise the lock pin from the locked position to the unlocked position, by the first pin being moved from the first retracted position to the first projected position; and a second locking unit including a second pin movable between a second projected position and a second retracted position, the second locking unit being configured to hold the lock pin at the unlocked position with the second pin from a horizontal direction, by the second pin being moved from the second retracted position to the second projected position;

wherein, when an unlock instruction is issued from the locking control unit, the second pin holds the lock pin at the unlocked position from the horizontal direction by moving from the second retracted position to the second projected position, after the first pin raises the lock pin from the locked position to the unlocked position by moving from the first retracted position to the first projected position, and after the lock pin is held at the unlocked position by the second pin at the second projected position, the first pin of the first locking unit moves from the first projected position to the first retracted position.

* * * * *